US005823232A

United States Patent [19]

Georgii

[11] Patent Number: 5,823,232

[45] Date of Patent: Oct. 20, 1998

[54] EMBROIDERY FABRIC STRIP WITH DEFORMABLE, SHAPE-RETAINING PROPERTIES

[75] Inventor: Andreas Georgii, Sindelfingen, Germany

[73] Assignee: Zweigart & Sawitzki, Sindelfingen, Germany

[21] Appl. No.: 882,586

[22] Filed: Jun. 25, 1997

[51] Int. Cl.[6] ..... D03D 15/02

[52] U.S. Cl. ..... 139/383 R; 139/425 R; 428/193; 428/906.6; 2/255

[58] Field of Search ..... 428/906.6, 192, 428/193; 139/425 R, 383 R; 112/439; 2/905, 906, 255; 442/6; 219/545, 211

[56] References Cited

U.S. PATENT DOCUMENTS

| | | | |
|---|---|---|---|
| 2,327,756 | 8/1943 | Adamson | 139/425 R |
| 3,632,966 | 1/1972 | Arron | 2/905 X |

FOREIGN PATENT DOCUMENTS

| | | | |
|---|---|---|---|
| 842050 | 2/1939 | France | 139/425 R |

*Primary Examiner*—Andy Falik
*Attorney, Agent, or Firm*—Kirschstein, et al.

[57] ABSTRACT

An embroidery fabric includes a main body consisting of interwoven weft and warp fibers that delimit between themselves respective rows and columns of openings for the passage of embroidery threads through them. At least one of the elongated marginal portions of the main body is substantially straight and is reinforced by one or more elongated reinforcing elements of a plastically deformable material secured to it and extending fully within the confines of, and at least substantially over the entire length of, such one marginal portion. The corresponding other marginal portion may also be reinforced in the same manner, while the intermediate portion situated between the marginal portions and having a width many times in excess of that of the marginal portions is devoid of any such reinforcement. The fabric is advantageously of an elongated, strip-shaped, configuration, and the affected marginal portions are those extending in the longitudinal direction of the strip-shaped fabric.

6 Claims, 1 Drawing Sheet

EMBROIDERY FABRIC STRIP WITH DEFORMABLE, SHAPE-RETAINING PROPERTIES

BACKGROUND OF THE INVENTION

1. Field of the Invention

The present invention relates to embroidery in general, and more particularly to the fabric used in making the same.

2. Description of the Related Art

The art of embroidery is an ancient one, and hardly any changes have been made in it since times immemorial. To recapitulate, it involves making adorning articles by passing threads of different colors with the aid of a needle or a similar instrument as individual stitches through holes pre-existing, or made or enlarged by the instrument, in a sheet- or strip-shaped substrate, thus creating different aesthetically pleasing patterns or even images or scenes that in some instances embellish the otherwise rather bland substrate, and in others completely cover the same, especially if the latter has a rather unappealing appearance or is preprinted with a faint "original" of the image or pattern to be replicated on the substrate by using the various colored threads.

The present invention is concerned with that kind of embroidery—hereafter referred to as cross-stitching or needlepoint regardless of the courses the particular stitches follow—in which the substrate—hereafter referred to as fabric irrespective of the kind of filamentary material it consists of—remains a part and parcel, albeit often a concealed one, of the finished article. In this milieu, the manner in which the fabric behaves while being handled either in the course of the embroidering process or afterwards, is of a critical importance.

So, for instance, it is well known even by those with a very cursory acquaintance with embroidery that not all kinds of textile materials or fabrics are well suited for use as the fabric as that term is being used here; rather, the textiles chosen for this purpose typically consist of fibrous materials—monofilaments, threads, yarns, strands or the like, either and all referred to hereafter as fibers without distinguishing among them—that not only form a mesh with clearly discernible holes or interstices between the individual fibers or the like arranged in generally orthogonally extending arrays, but also, while still flexible, possess a certain, rather pronounced, degree of stiffness or rigidity. This is so because it is very difficult, if not impossible, to provide the desired patterns or images on fabrics that behave as if "alive", i.e. change the courses along which they extend seemingly indiscriminately in response to every little external influence, be it a minuscule movement of the embroiderer's fingers or a whiff of air. To avoid this undesirable effect, it is a frequent practice of the embroiderers to span the fabric, even a relatively stiff one, over a rigid frame that confers increased rigidity to the portion of the fabric being worked on. Of course, this increase in rigidity is a temporary one and does not carry over into the finished article.

It goes without saying that it would be possible to solve the above-mentioned handling problem and/or avoid the attendant need to use a reinforcing frame by using for the fabric one that consists in its entirety of fibers of sufficiently high stiffness for the fabric not to yield in such an objectionable manner. This, however, would not be a very practical solution in many cases because the resulting article would be rather unwieldy so that it would not gracefully drape itself around corners if used as an embellishment of or a cover for a horizontal surface of an article of furniture, or around curtains, draperies or the like if used as an adorning holder for their central to lower regions or in many other known applications; just about the only use for such a stiff article would be if it were to be hanged on a wall either by itself—a Gobelin tapestry of sorts—or mounted in a frame. Besides, such a stiff article would not be too pleasant to touch—again a pronounced disadvantage in many possible uses. The same or similar considerations would also apply if just the warp fibers, or just the weft fibers of the woven fabric possessed the higher rigidity, and the situation would not be much better even if only some of such warp or weft fibers, substantially equally distributed throughout the respective fiber array, were to exhibit such increased rigidity.

It is probably for the reasons mentioned above why such uniform uni- or bi-directional internal fabric rigidification or reinforcement has not been successfully proposed and/or employed before in embroidery fabrics, even though it has been suggested for use in other fields of human behavior, as exemplified by the U.S. Pat. Nos. 4,467,006 to Hasegawa et al., 4,567,094 to Levin or 4,861,645 to Standing.

Of these patents, the only one in which such a stiffening is actually the desired result rather than an incidental byproduct of a measure taken for a different purpose is the Hasegawa et al patent. It is disclosed there that a metallic fiber, extending along a serpentine path from one edge of a reinforcement cloth strip to the other and back, can be used to give the strip "staying power", that is to cause it to generally retain the shape that has been impressed onto it. While this approach may well achieve excellent results in the field for which it has been developed, namely that of making molded synthetic plastic material articles of intricate shapes including embedded reinforcements or mesh-like skeletons, it would not be suited at all for use in embroidery, precisely for the reasons mentioned before, especially because it would result in overall rigidification of the fabric and hence of the final article—an undesired effect.

The other two patents are concerned with making the weave, mesh or fabric conductive so as to, for instance, avoid local accumulation of an electric charge (static electricity) or assure delivery of electric current to remote regions of a strip at all times. In the Standing patent, this is achieved by substituting electrically conductive (metallic) fibers at regular intervals throughout the strip for the graphite or similar fibers constituting the regular warp fibers, while in the Levin case a similar effect is accomplished by wrapping very thin electrically conductive wires around selected, regularly distributed ones, of the warp (and also the weft) fibers. While neither one of these patents is concerned with or even mentions the reinforcing effect of such metallic fibers on the remainder of the strip, it is more than likely that it exists in both instances; if so, the aforementioned disadvantages stemming from the presence of the reinforcements throughout the strip, albeit at regular intervals, are encountered here as well. Hence, it would be totally futile, useless and even counterproductive to try to use either one of the three variations of the same overall concept of dispersing the reinforcing fibers throughout the strip as disclosed by the above three patents in the manufacture of fabrics for use in the embroidery field.

OBJECTS OF THE INVENTION

Accordingly, it is a general object of the present invention to avoid the disadvantages of the prior art.

More particularly, it is an object of the present invention to provide an embroidery fabric that does not possess the drawbacks of the known fabric of this type.

Still another object of the present invention is to devise an embroidery fabric of the type here under consideration which, and especially the article made of the same by utilizing well-known cross-stitching or needlepoint techniques, can be deformed to any desired shape and will retain it even after the termination of the deformation forces.

It is yet another object of the present invention to design the above embroidery fabric in such a manner that the overall look and feel of the embroidered article made on such fabric is the same or better than in the traditional articles of this kind despite the shape-retaining properties of such fabric.

A concomitant object of the present invention is so to construct the embroidery fabric of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in an embroidery fabric which includes a main body including two filamentary arrays each including a multitude of substantially parallel fibers that are interwoven with those of the respective other array and extend substantially normal thereto to form between themselves respective rows and columns of openings for the passage of embroidery threads through them. The body has two elongated marginal portions spaced from one another by an intervening portion of a width many times exceeding that of the marginal portions. At least one of the marginal portions is substantially straight and extends in substantial parallelism to the fibers of one of the filamentary arrays.

In accordance with the present invention, there is further provided reinforcing means for reinforcing at least the aforementioned one of the marginal portions of the body to the exclusion of at least the intervening portion, including at least one elongated reinforcing element of a plastically deformable material secured to the one marginal portion and extending fully within its confines at least substantially over the entire length of the one marginal portion. A particular advantage of the fabric of the present invention as described so far is that the reinforcing means, by virtue of being absent from the intervening portion, does not adversely impact the properties of such intervening portion and ultimately of the final article made with the use of the fabric, that is it does not impose unnecessary and undesirable rigidity on the intervening portion, while at the same time the increased rigidity that the reinforcing means confers, but only on the affected marginal portion of the fabric, renders it possible to give the article any desired shape for the article to stay in indefinitely. Advantageously, the reinforcing element is secured to the main body by being interwoven with its weft fibers.

A particularly advantageous construction of the embroidery fabric of the present invention is obtained when the reinforcing means includes at least one further elongated reinforcing element similar to the one elongated reinforcing element and extending substantially parallel thereto also fully within the confines of, and at least substantially over the entire length of, the one marginal portion. This improves the shape-retaining function, while the confinement of the reinforcing means, no matter how many of the elongated elements it includes to the marginal portion area, still avoids the detrimental effect that inclusion of reinforcing elements in the intervening portion would have on the properties of the article at that area.

The above is also true when, in accordance with another aspect of the present invention, the other of the marginal portions is also elongated and substantially straight, and the reinforcing means further includes at least one additional elongated reinforcing element of a plastically deformable material secured to the other marginal portion and extending fully within the confines thereof at least substantially over the entire length of the other marginal portion. In this instance as well, the reinforcing means advantageously includes at least one further additional elongated reinforcing element similar to the one additional elongated reinforcing element and extending substantially parallel thereto also fully within the confines of, and at least substantially over the entire length of, the other marginal portion.

Last but not least, it is to be mentioned that especially advantageous results are obtained when the main body has an elongated, strip-shaped configuration, and the one marginal portion extends, or both of the marginal portions extend, longitudinally of the main body. The particular advantage of this approach is that, because of the relative narrowness of the body and hence of the resulting article, preferably on the order of 5 cm to 15 cm, the width of the intervening portion, while still many times that of the marginal portions, is small enough for the reinforcing means to have a profound effect—not a rigidifying one, though, but rather a shape-conferring one—on the intervening portion. More particularly, if so desired, the marginal portions can be deformed in such a manner that the interfering portion obtains a series of regular or even irregular peaks and valleys, thus complementing the inherent softness of the intervening portion to the touch with a visual representation of this quality.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
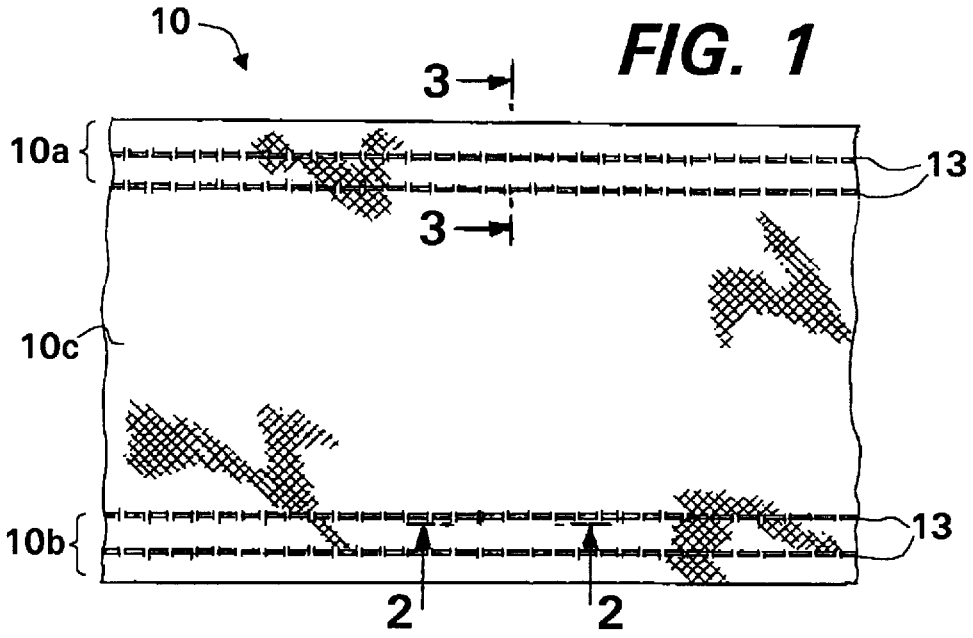
FIG. 1 is a top plan view of a fragment of an embroidery fabric strip embodying the present invention at a scale that may substantially correspond to reality.

Referring now to the drawing in detail, and first to FIG. 1 thereof, it may be seen that the reference numeral 10 has been used therein to identify a fabric strip embodying the present invention, in its entirety. As its name implies, the strip 10 not only is longer than it is wide, but also is intended to serve as a fabric as that word is used in the world of arts and crafts, that is as a substrate for a rendering, in this case that produced by resorting to cross-stitching or needlepoint techniques.

Figure 2:
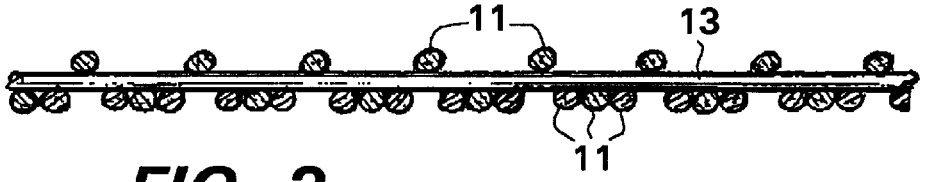
FIG. 2 is a longitudinal sectional view through a portion of the fabric strip fragment, taken on line 2—2 of FIG. 1, on a greatly exaggerated scale.
Figure 3:
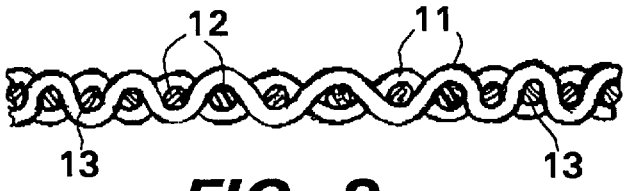
FIG. 3 is a cross-sectional view taken through another portion of the strip fragment on line 3—3 of FIG. 1, on a scale substantially corresponding to that of FIG. 2.

As such, the fabric 10 includes two arrays of substantially orthogonally extending weft and warp fibers 11 and 12 that are visible particularly in FIGS. 2 and 3 of the drawing, respectively. In order not to unduly encumber the drawing, though, not all of such weft and warp fibers 11 and 12 are identified by the respective reference numerals in the drawing, and they are not individually shown in FIG. 1 at all; rather, their presence is merely indicated there by appropriate regional shading or cross-hatching. It will be appreciated, though, that the actual orientation of the fibers is not what it would appear from the cross-hatching; rather, the warp fibers 12 extend longitudinally of the strip 10, while the weft fibers 11 extend in the transverse direction of the strip 10.

The fabric strip 10 is produced by a well-known weaving process on a loom or a similar machine in that sub-arrays of alternate ones of the warp fibers 12 are moved up or down as a shuttle pulls the weft fiber 11 first in one transverse direction and then, after the sub-arrays of the alternating fibers 11 have exchanged their positions, in the opposite transverse direction through the V-shaped gap delimited by such sub-arrays. This method, which is well known in the textile industry, results in a structure depicted in FIG. 3 of the drawing in which the warp fibers 12 undulate between the weft fibers 11 and vice versa meaning that the fibers 11 and 12 alternatingly pass over and under one another as considered both in the longitudinal and in the transverse direction of the strip 10.

Yet, the structure of the fabric strip is not as tight as it would appear to be from observing FIG. 3 of the drawing; rather, the fibers 11 and 12 form a mesh with respective holes or interstices between the respective adjacent ones of the fibers 11 and 12. These holes are arranged in respective row and column arrays extending in the weft and warp directions, respectively, and serve initially as visual guides for determining, by counting the number of the intervening fibers, through which of them a needle pulling a colored thread is to pass next in the course of the embroidering process to form a respective stitch of the desired or predetermined length, and subsequently for the passage of the needle and of the thread through it. In a cross-stitching fabric, the holes along both said directions are all of the same size. All this is well known, so that it need not be elaborated upon any more.

Unlike conventional formations of this kind that are uniform in construction throughout, the strip 10 of the present invention is provided, in at least one of its longitudinally extending marginal portions 10*a* and 10*b*, with at least one elongated reinforcing element 13. As illustrated particularly in FIG. 3 of the drawing, the element 13 is incorporated into the strip structure in lieu of a corresponding warp fiber 12; however, it is conceivable and contemplated by the present invention to situate the element 13 next to the respective warp fiber 12 so that both the element 13 and the adjacent fiber 12 pass through the very same space delimited by the respective undulation of each of the two adjacent weft fibers 11.

Moreover, the element 13 does not necessarily pass through each and every possible such space that it encounters or would be able to form on its way; rather, as a comparison of FIGS. 1 and 2 with one another will reveal, the element 13 may skip or bypass every second one of such possible spaces, so that it passes under one of the warp threads 11, then over the next three of such warp threads 11, then under the next one, then over the following three, etc. This is possible to accomplish even if the remainder of the fabric structure is regular (with the respective adjacent warp fiber 12 passing alternatively over and under the successive weft threads) in that the element 13 joining the adjacent warp thread 12 during its passage through one of such spaces but bypassing the next one, then rejoining, then bypassing again, etc.

The element 13 is made of a material that is bendable, but does not exhibit any, or only a very small or negligible amount of, resilience. Materials that satisfy these requirements are certain metals, metalloids and metal alloys; therefore, the elongated element 13 will henceforth be referred to, in the alternative, as a wire. It may be seen especially in FIG. 1 of the drawing that there are four such wires 13 incorporated in the structure of the elongated fabric strip 10, but not uniformly or equidistantly spaced throughout the width of the strip 10. Rather, such wires 13 are arranged in respective pairs, relatively close to one another, only in the respective longitudinal marginal portions 10*a* and 10*b* of the strip 10.

As alluded to before, just one, rather than the illustrated two, wires 13 may be used in the respective marginal portion 10*a* or 10*b*; moreover, more than two of such wires 13 may be used in the respective marginal portion 10*a* or 10*b*. The number of the wires 13 may be the same in both of the marginal portions 10*a* and 10*b*, or may differ from each other even to the extent that one of such marginal portions 10*a* and 10*b* contains no wire 13, as may have already been inferred from some of the above statements.

In any event, though, the wire or wires 13 are present exclusively in the marginal portions 10*a* and 10*b*, and an intervening portion 10*c* of the strip 10 that is situated intermediate such marginal portions 10*a* and 10*b* is totally devoid of such wires 13. As a result, the fabric 10 exhibits the desired so-to-speak indiscriminate pliability in between such marginal portions 10*a* and 10*b*, but is merely flexible and/or bendable at its marginal portions 10*a* and 10*b*, so that the built-in courses along which such marginal portions 10*a* and 10*b* extend are, on the one hand, predetermined and constant so long as the forces acting on the marginal portions 10*a* and 10*b* are within the range of elastic deformation of the wires 13, and alterable at will by applying forces exceeding such range, that is in the plastic deformation range of the wires 13, to selected regions of such marginal portions 10*a* and 10*b*, on the other hand. Of course, once the wires 13 are thus deformed, they will have a tendency to retain their shape forever or until, again, sufficiently high external forces to overcome this tendency and cause another plastic deformation are applied to the respective selectively affected regions of the marginal portions 10*a* and 10*b*.

While this combination of a relatively pliable intermediate portion 10*c* of the fabric strip 10 with the relatively more rigid, albeit deformable, marginal portions 10*a* and 10*b* may bring about certain advantages already during the creation of the embroidery, namely those stemming from the fact that the thus reinforced marginal portions 10*a* and 10*b* constitute a kind of a built-in frame facilitating the handling of the fabric strip 10 by the embroiderer, its real advantage comes to the fore only when the embroidered article is finished and is to be used for various decorative purposes, such as an ornamental holder for a curtain or a drape. Then, the fact that only the marginal portions 10*a* and 10*b* of the strip 10 are reinforced with the bendable wires 13 while the region 10*c* between them remains pliable renders it possible to give the strip 10 any desired shape, including the aesthetically pleasing puffed-up look where the marginal portions 10*a* and 10*b* are closer to one another than what would correspond to the width of the strip 10 and follow not only arcuate but undulating courses, so that a seemingly random series of peaks and valleys forms in the pliable region 10*c* between them, an effect that would not be obtainable if the intermediate region 10*c* were reinforced too.

A further advantage of this approach is that, inasmuch as in this application and others similar to it the region of the strip 10 that a nearby person is likely to brush against or otherwise come into contact with is the central region 10*c* that contains none of the wires 13 and hence is rather pliable and otherwise pleasant to the touch, the overall tactile impression of the article is the same if not (because of the additional "softening" resulting from the peak-and-valley configuration) better than that encountered in the context of traditional (not reinforced) strips of this nature. These and similar advantages arising from the fact that the marginal portions 10*a* and 10*b* or the fabric strip 10, and only they, are reinforced in accordance with the present invention, are above and beyond those attributable merely to the reinforcement of the strip 10, such as the ability to assume and retain a certain shape.

Depending on the type of embroidery with which the strip 10 is adorned, the wires 13 may be completely obscured from view by the aforementioned stitches, so that their very existence is concealed from casual observers. However, even if the cross-stitching or similar needlepoint creation does not cover the entire strip 10 and especially the parts of the marginal portions 10*a* and 10*b* at which the wires 13 are located, the wires 13 are still hardly noticeable except on close inspection, especially when, in accordance with the present invention, they are rather thin (much thinner than the fibers of the fabric 10) and of a color (such as silvery, grey or the like) that blends into the background constituted by the fibers of the fabric 10. Furthermore, even if they could be seen, they still would not adversely affect the overall appearance of the strip 10; as a matter of fact, they could be considered or made to appear to be a part of the ornamental design of the article.

It will be appreciated that at least most of the above advantages, if not all, would also be present to a greater or lesser degree if only one of the marginal portions 10*a* or 10*b* were provided with one or more of the wires 13. It will also be realized that, while the present invention has been developed for, and finds a highly advantageous application in, embroidery strips 10 of about 5 cm to 15 cm in width, it could also be used in conjunction with other shapes and sizes of embroidery fabrices, with the same or similar advantages. So, for instance, the marginal portion wires 13 could confer "plastic" (relief) looks to embroidered articles to be used as tapestries, but they could also be employed in embroidered articles to be used as doilies of sorts or for similar ornamental and/or utilitarian purposes; in that case, the inherent plastic deformability of the wires 13 would make it possible to drape the article around obtuse-, right-, or even acute-angle corners of furniture pieces or the like so that the very presence of such wires 13 would be hardly noticeable from the way the article would drape itself around the respective corner or even from the "feel" of the article, and yet the shape-retaining action of such wires 10 would be there, but only in the likely-to-curl marginal portions while the rest of the article would remain pliable and retain the "soft" looks and touch. For greater decoration value, the outer edges of both marginal portions can be scalloped or otherwise configured.

It will be understood that each of the elements described above, or two or more together, may also find a useful application in other types of constructions differing from the type described above.

While the present invention has been described and illustrated herein as embodied in a specific construction of a strip-shaped embroidery fabric, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

I claim:

1. An embroidery fabric, comprising;

a) a main body having an elongated, strip-shaped configuration having a width in a range from 5 cm to 15 cm and including two filamentary arrays each including a multitude of substantially parallel fibers that are interwoven with those of the respective other array and extend substantially normal thereto to form between themselves respective rows and columns of openings for the passage of embroidery threads therethrough, said openings along said rows and said columns all being of equal size, said body having two elongated marginal portions extending longitudinally of said main body and spaced from one another by an intervening portion of a width many times exceeding that of said marginal portions, at least one of said marginal portions being substantially straight and extending in substantial parallelism to said fibers of one of said filamentary arrays; and b) reinforcing means for reinforcing at least said one of said marginal portions of said body to the exclusion of at least said intervening portion, including at least one elongated reinforcing element of a plastically deformable material secured only to said one marginal portion and extending fully within the confines thereof at least substantially over the entire length of said one marginal portion.

2. The embroidery fabric as defined in claim 1, wherein said reinforcing means includes at least one further elongated reinforcing element similar to said one elongated reinforcing element and extending substantially parallel thereto also fully within the confines of, and at least substantially over the entire length of, said one marginal portion.

3. The embroidery fabric as defined in claim 1, wherein the other of said marginal portions is also elongated and substantially straight; and wherein said reinforcing means further includes at least one additional elongated reinforcing element of a plastically deformable material secured only to said other marginal portion and extending fully within the confines thereof at least substantially over the entire length of said other marginal portion.

4. The embroidery fabric as defined in claim 3, wherein said reinforcing means includes at least one further additional elongated reinforcing element similar to said one additional elongated reinforcing element and extending substantially parallel thereto also fully within the confines of, and at least substantially over the entire length of, said other marginal portion.

5. The embroidery fabric as defined in claim 1, wherein said reinforcing element is secured to said main body by being interwoven with said weft fibers thereof.

6. The embroidery fabric as defined in claim 1, wherein said reinforcing element is a wire.

* * * * *